United States Patent [19]

Kordecki

[11] Patent Number: 5,048,121

[45] Date of Patent: Sep. 17, 1991

[54] SYSTEM FOR BOTTLE FEEDING AN INFANT

[76] Inventor: John Kordecki, 515 Olive St., Hoffman Estates, Ill. 60194

[21] Appl. No.: 507,251

[22] Filed: Apr. 9, 1990

Related U.S. Application Data

[62] Division of Ser. No. 382,475, Jul. 17, 1989.

[51] Int. Cl.[5] ..... A41B 13/00; A41B 13/10; A41D 11/00

[52] U.S. Cl. ..... 2/49 R; 2/46

[58] Field of Search ..... 2/46, 48, 49 R, 49 A, 2/50, 51, 52, 75, 80, 113, 115, 119, 120

[56] References Cited

U.S. PATENT DOCUMENTS

| | | | |
|---|---|---|---|
| 2,430,941 | 11/1947 | Long | 2/49 R |
| 2,525,115 | 10/1950 | Britton | 2/49 R |
| 2,558,414 | 6/1951 | Blackman | 2/49 A |
| 2,783,472 | 3/1957 | Lenger | 2/49 R |
| 2,884,638 | 5/1959 | Ream | 2/49 R |
| 3,016,544 | 1/1962 | Pinkney | 2/49 R |
| 3,042,930 | 7/1962 | Martinez | 2/49 R |
| 3,871,027 | 3/1975 | Orr | 2/49 R |
| 4,330,888 | 5/1982 | Klepfer | 2/48 |

FOREIGN PATENT DOCUMENTS

| | | | |
|---|---|---|---|
| 447506 | 3/1948 | Canada | 2/49 R |
| 2501926 | 7/1976 | Fed. Rep. of Germany | 2/49 R |
| 804118 | 10/1936 | France | 2/49 |

*Primary Examiner*—Werner H. Schroeder
*Assistant Examiner*—Jeanette E. Chapman
*Attorney, Agent, or Firm*—Wallenstein Wagner & Hattis, Ltd.

[57] ABSTRACT

A system for bottle feeding an infant comprises a bib 14, a base 16 adapted to rest on the infant, a bottle holder 18 hingeably attached to the base 16 for securing a bottle thereto, and a bib slot 20 operatively associated with the base for frictionally engaging the bib 14 so that the bit 14 is held to the base securely for purposes of feeding an infant and can be slid in and out of the slot means as desired. Pressure sensitive adhesive strips 31 and 33 may be added to bib 14 to hold the bib 14 to the infant. The bottle holder 18 is continuously angularly adjustable along a mast 22 to finely and continuously adjust the feeding rate. One end 32 of the bottle holder 18 presents a flat edge so that the bottle holder may be placed on a flat surface to position a bottle B in an upright position when the system 10 is not in use on the infant. The base 16 is contoured to fit an infant's torso with portions 48 engaging the infant's inner thigh to support the base.

7 Claims, 3 Drawing Sheets

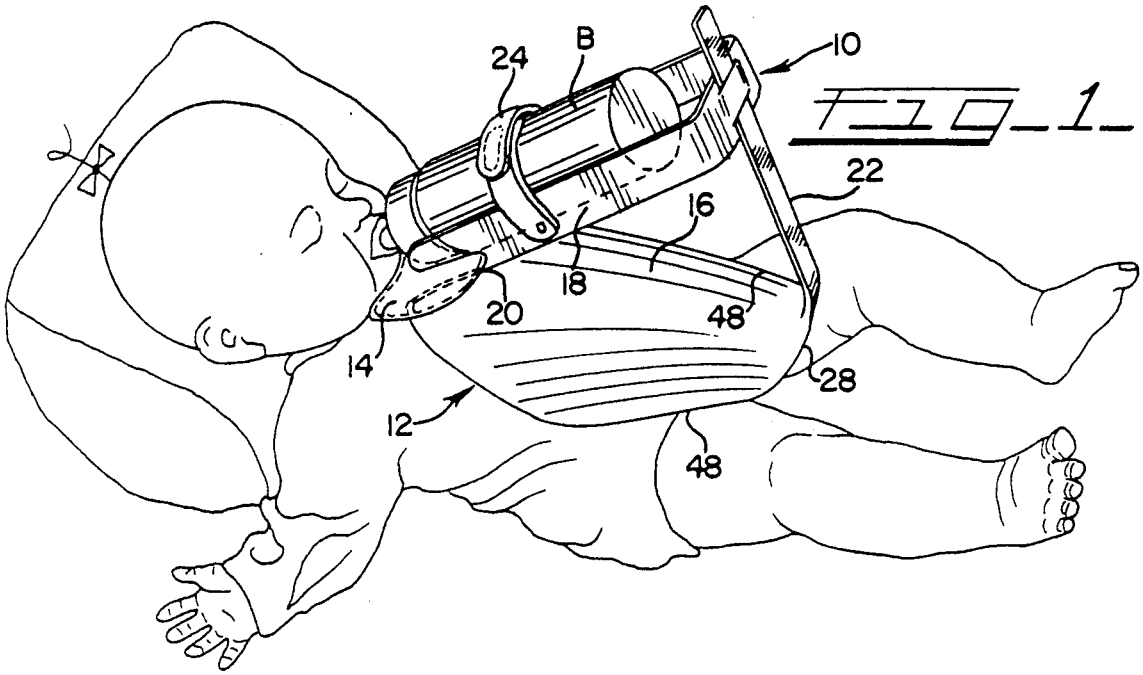
FIG. 1
FIG. 2
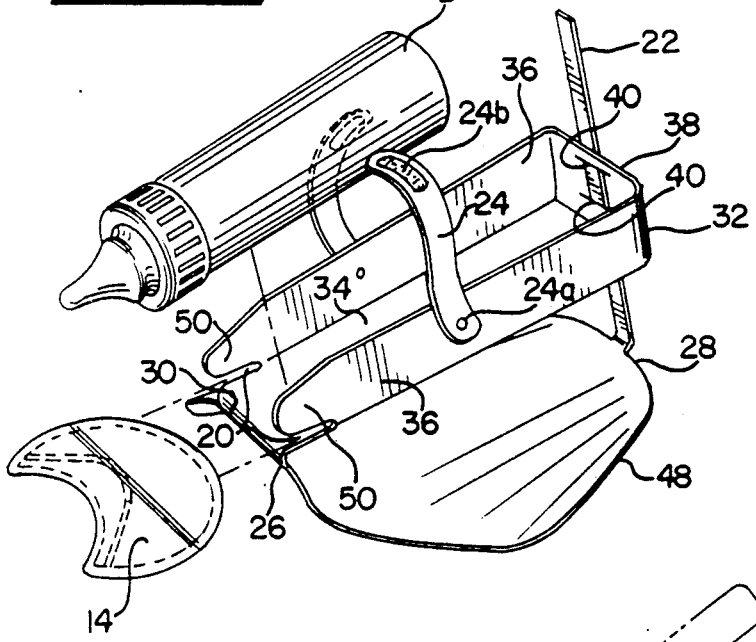
FIG. 3
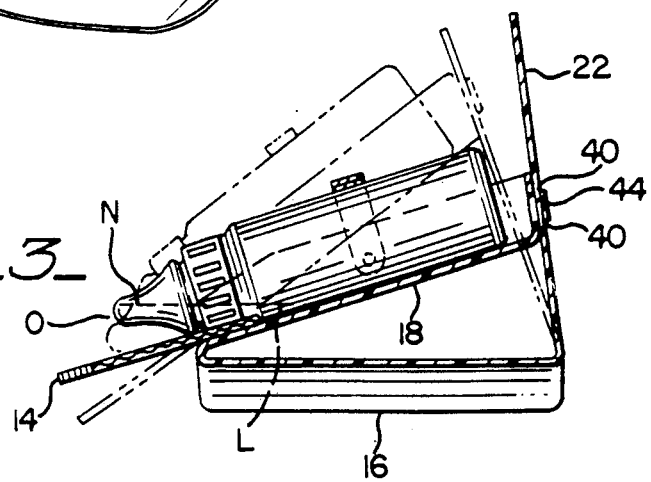

SYSTEM FOR BOTTLE FEEDING AN INFANT

REFERENCE TO RELATED APPLICATION

This application is a divisional of copending U.S. application Ser. No. 07/382,475, filed on July 17, 1989.

TECHNICAL FIELD

The present invention relates generally to a system for bottle feeding an infant and more particularly to an apparatus for supporting a bottle in a desired position for an infant to nurse from the bottle without human support of the bottle and particularly to such devices incorporating a disposable bib.

BACKGROUND OF THE INVENTION

In some instances it is preferable or necessary to bottle feed an infant such as when the infant requires a special diet. When bottle feeding an infant, it is also sometimes preferable or necessary to allow the infant to nurse while not being held, such as when the attending parent is preoccupied with household duties or attending other children. In such instances, attending parents have been known to support the nursing bottle in a feeding position by using a towel or pillow positioned beside the infant as a support. Such makeshift devices are usually ineffective because it is difficult to maintain the bottle in a feeding position due to movement by the infant.

Furthermore, it has recently become very popular for parents to secure their infants into reclining seats during the day while the parents perform daily chores. The use of such seats is advantageous to both parent and child because it allows a child to be with a parent while the parent is conducting necessary activities. While in such a seat, it is even more difficult to use a makeshift support for a nursing bottle.

Also, it is well known that infants must be burped periodically during a feeding to expel air swallowed while nursing. If excess amounts of liquid are consumed in one feeding interval without burping, the infant can suffer gastric distress. This especially becomes a problem when a bottle is supported for nursing. Without the continuous interaction as provided by hand holding of the bottle, it is difficult to meter how much liquid will be received by the infant in a given feeding interval.

Another problem which exists with respect to feeding an infant with a supported bottle is that any milk or formula which leaks from the bottle is free to soil surrounding bedding or the infant. Although traditional bibs, which fasten around an infant's neck, provide some protection, such bibs are ineffective when a nursing bottle is propped to the side of the infant's head.

Others have devised various types of devices for holding a nursing bottle in a feeding position adjacent an infant's mouth. Although these devices have achieved some measure of success, they are all subject to disadvantages not found in the present invention and have not adequately addressed the problems presented in the art.

For example, Daust U.S. Pat. No. 2,631,288 discloses a bottle holding device comprising a wedge-shaped supporting cushion structure with an overlying bottle holding band or cover that holds and positions a bottle. The device also includes a bib which is detachable from the supporting cushion. The bib attaches around a child's neck by use of straps which are tied around the child's neck. The bib and bottle holding device disclosed by Daust suffers from the following disadvantages. First, the cushion does not provide for a variable feeding rate. Second, the bib requires tying around a child's neck which is cumbersome. Because the bottle holding device is attached to the bib, the device becomes unsafe by being tied around a child's neck. Finally, the bib is attached by expensive snaps which are incorporated into the bib, thus making the bib non-disposable. The bib, once soiled, must be laundered.

Williams et al. U.S. Pat. No. 2,880,950 discloses a nursing bottle holder having an arcuate base which is supported on the chest of an infant, a bracket extending upward from the base and a bottle gripping clamp pivotally connected to an upper portion of the bracket.

Although the bottle holder disclosed by Williams et al. provides for a variable angle of the bottle, it does not provide for an easily reproducible feeding rate. Furthermore, the bottle holder disclosed by Williams et al., although having an arcuately shaped base, must be supported on an infant by the hand of the attending parent.

Adler U.S Patent No. 4,405,106 discloses a bottle holder including a base for resting upon the chest of an infant, a bottle holding member which is hingeably joined to the base, and a prop hinged to the bottle holding member. The prop engages a plurality of engagement means for step-wise variation of the angle of a bottle. The bottle holder disclosed by Adler is subject to several disadvantages. First, the base of the bottle holder is flat. Thus, the bottle holder must be held to an infant by hand or a strap must be used to stabilize the bottle holder on the child. The flat shape engaging the infant's chest, may cause considerable discomfort to an infant. More discomfort and inconvenience is presented by use of a strap to secure the base. Second, although the bottle holder disclosed by Adler does allow for a variable and reproducible bottle angle to adjust feeding rate, the adjustment is somewhat cumbersome. For example, in order to change angles the prop must be first disengaged from one engagement means. Then the bottle holder must be lifted or dropped while at the same time the prop is directed into engagement with an alternate engagement means. Also the adjustment is step-wise, not continuous. A continuously adjustable rate is advantageous, for example, to more accurately reflect the continuous increase of the infant's feeding capacity as the infant develops.

None of the bottle holding or propping devices described above, provide means for allowing the device to be supported on a flat surface such as a table in a position wherein a bottle held by the device is in an upright position.

Applicant's invention is provided to solve these and other problems.

SUMMARY OF THE INVENTION

It is an object of the invention to provide a system for bottle feeding an infant. According to the invention, the bottle feeding system comprises a bottle prop and a bib cooperable therewith. The bottle prop generally includes a base adapted to rest on the infant, a bottle holder attached to the base for securing a bottle thereto, and a slot operatively associated with a forward portion of the bottle prop for frictionally engaging the bib so that the bib is held to the base securely for purposes of feeding an infant and can be slid in and out of the slot as desired.

Frequently nursing bottles leak when they are inverted to be positioned in an infant's mouth. Such leakage is particularly common when the bottle is full prior to feeding. The present invention provides for the nipple of a bottle to extend from the bottle holder to a point above the bib while the bib is engaged in the slot. This provides for absorption of any leakage from the nipple or bottle closure during transfer of the bottle to an infant while the bottle is inverted.

In an alternate embodiment, the bib includes a pressure sensitive adhesive on one of its sides for adhering the bib to the infant's clothing. Advantageously, this provides for the bib to be automatically withdrawn from the slot and remain in place when the base is removed from the infant. The pressure sensitive adhesive also allows the bib to be used subsequent to feeding for any liquid which may be expelled by the infant during burping.

According to another aspect of the invention the base of the bottle prop is shaped to generally fit the contours of an infant's torso. The base has opposed first and second ends and a peripheral edge. The first end is disposed near the neck of an infant while the second end extends to a point between the infant's legs (or to a point below the infant's hips). Two recessed portions are formed in the peripheral edge of the base proximate the second end. The recessed portions are adapted to accommodate the inner thigh of an infant when the infant's legs are bent, such as when seated in a reclined baby seat. In this position, the base on the infant is stabilized by the contoured shape of the base and by the engagement of the recessed peripheral edges disposed between the infant's legs.

According to another aspect of the invention, the bottle holder has opposed first and second bottle holder ends with the first bottle holder end being hingeably attached to the base proximate the first base end. A mast is hingeably attached to the base proximate to the second base end. The bottle holder has attaching means which provide for the movable attachment of the bottle holder to the mast so that an angle of the bottle holder with respect to the base can be continuously adjusted by slidable repositioning the bottle holder along the mast. Indicia are provided on the mast to permit reproducible repositioning of the bottle holder.

The bottle prop of the invention is adapted to support itself on a flat surface such as a table so that the bottle is facing in an upright position. This avoids leakage from the bottle or soiling of its nipple when the system is not in use on an infant such as when the infant is being burped between feeding intervals.

The bib of the system generally comprises a substrate being generally flat with opposed side surfaces. Preferably the substrate has a generally circular periphery which among other things enhances the ease of disposing the bib into the slot. A portion of the periphery of the substrate is recessed in an arcuate shape to fit only around a front portion of an infant's neck under the chin. As noted above, in an alternate embodiment a pressure sensitive adhesive is disposed on one side surface of the substrate for adhering the substrate to a wearer. The use of the adhesive is far safer and more convenient than using straps tied around an infant's neck.

According to another aspect of a bib of the invention, the substrate includes at least two layers superimposed on and attached to each other. A formable member is disposed between the layers of the substrate whereby the substrate may be adjustably shaped to the contours of the wearer by shaping the formable member.

In another embodiment of the bib, the substrate includes a seam formed across a medial portion of the substrate joining the layers along the seam and defining an upper portion and a lower portion of the substrate. An elongated rigid member is disposed between the layers in the upper portion. The rigid member has two legs joined at a central point. The rigid member is oriented so that the central point of the rigid member abuts the seam with the legs generally encompassing the recessed portion of the periphery. The rigid member so disposed adds rigidity to the upper portion and tends to maintain the bib in a given position. This permits the lower portion of the substrate to be hingeably movable with respect to the upper portion of the substrate. Thus, the bib can be flipped up to cover the mouth of an infant and flipped down on the infant's chest.

Other advantages and aspects of the invention will become apparent upon making reference to the specification, claims, and drawings to follow.

BRIEF DESCRIPTION OF THE DRAWINGS

FIG. 1 is a perspective view of the system for feeding an infant from a nursing bottle in use with an infant;

FIG. 2 is an exploded perspective view of the system of FIG. 1;

FIG. 3 is a cross-sectional view of a the system of FIG. 1, showing the variable positioning of the bottle holder;

DETAILED DESCRIPTION OF THE INVENTION

Figure 4:
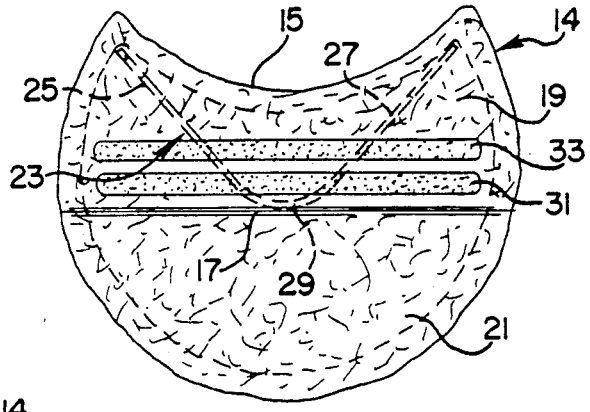
FIG. 4 is a bottom view of a bib of the system of FIG. 1.

While this invention is susceptible of embodiment in many different forms, there is shown in the drawings and will herein be described in detail preferred embodiments of the invention. The present disclosure is to be considered as an exemplification of the principles of the invention and is not intended to limit the broad aspect of the invention to the embodiments illustrated.

FIG. 1 discloses a system 10 for bottle feeding an infant. The system generally includes a bottle prop 12 (shown in FIG. 1 with a bottle B secured therein) and a disposable bib 14 cooperable therewith.

As best seen in FIGS. 1, 2, 3 and 7 the bib 14 of the system 10 is frictionally engaged in a bib slot 20 of the bottle prop 12. The bib slot 20 supports the bib 14 in a substantially erect position. This allows the user to guide the bib under an infant's neck by merely guiding the bottle prop 12 as it is placed on the infant. The bib 14 in this position also provides for absorption of any leaks from the bottle B when the bottle B is inverted in the bottle prop 12. This is particularly advantageous when transferring the bottle to and from the infant with the bottle is secured into the bottle prop 12 because the bottle B must be facing downwardly while the bottle prop 12 is positioned on an infant.

In an alternate mode of using the system 10, the bib 14 is adhered to the infant by a pressure sensitive adhesive. In this mode, use of the pressure sensitive adhesive in the system 10 is advantageous because the bottle prop 12 can simply be lifted from the infant between feeding intervals and the bib 14 will slide out of the bib slot 20 and remain on the infant for absorption of any liquids expelled by the infant.

FIGS. 1 through 7 disclose one embodiment of the bottle prop 12. The bottle prop 12 generally includes a base 16, a bottle holder 18, a mast 22 and a strap 24 to secure the bottle B into the bottle holder.

The base 16 is adapted to rest on the torso of an infant. As best disclosed in FIG. 2, the base 12 has a first base end 26 normally disposed toward an infant's neck and a second base end 28 opposite the first base end 26.

The bottle holder 18 has opposed first and second bottle holder ends 30 and 32. The first bottle holder end 30 is hingeably attached to the base 16 proximate the first base end 26. The bottle holder 18 includes a support member or bottom wall 34 to support the bottle B. Opposed side walls 36 and an end wall 38 extend perpendicularly from the bottom wall 34 to form a three sided enclosure around the bottle B. The end wall 38 is at bottle holder end 32 while bottle holder end 30 is open to allow the bottle B to protrude from the bottle prop 12 for access to an infant's mouth. The bottle holder 18 is dimensioned so that any conventional bottle, such as bottle B, will reside therein.

Preferably the strap 24 consists of two segments, each with opposed ends **24*a* and 24*b*. Each side wall 36 has an end 24*a* of one strap segment attached to its midpoint. The opposed ends 24*b* of the strap segments have mating VELCRO TM surfaces so that the ends 24*b* can be secured around the bottle B residing in the bottle holder 18**.

As best disclosed in FIGS. 1, 2 and 3, side walls 36 terminate at the first bottle holder end 30 in the form of tabs 50. Bottom wall 34 of bottle holder 18 extends below the tabs 50. Thus the tabs 50 and the bottom wall 34, at first end 30 of bottle holder 18, define bib slot 20. Bib slot 20 is dimensioned to present an interference fit with at least a margin along the periphery of bib 14 of system 10.

The mast 22 is generally flat and is hingeably attached to the base proximate to the second base end 28. As best disclosed in FIGS. 3 and 6, the bottle holder 18 has two spaced parallel openings or mast slots 40 formed in end wall 38. A portion 44 of end wall 38 is defined between the mast slots 40. The mast 22 is disposed through both mast slots 40. Mast slots 40 and mast 22 are cooperably dimensioned so that mast 22 is slidable within the mast slots 40. Thus the bottle holder 18 is slidable along the mast 22. This permits the angle of the bottle holder 18 with respect to the base 16 to be continuously adjusted to vary the feeding interval.

The mast slots 40 are in the same plane, therefor the portion 44 of end wall 38 between the mast slots 40 is constantly urged against the mast causing a frictional engagement. The frictional engagement is sufficiently strong to maintain the bottle holder in a stabile position when a completely filled bottle B is secured thereto. The frictional engagement can easily be overcome, for adjustment, by simply either pushing the bottle holder 18 toward the base 16, or by holding the base 16 with one hand and pulling the bottle holder 18 away from the base 16 with the other hand.

Figure 6:
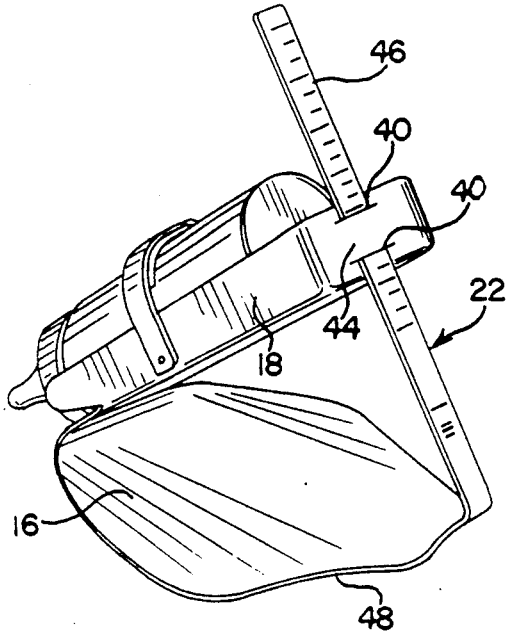
FIG. 6 is a rear perspective view disclosing feeding interval reproducibility indicia on the bottle prop of the present invention.

The slidable adjustment of bottle holder 18 provides for infinitely fine and continuous adjustment along mast 22 as best disclosed in FIG. 3. As shown in FIGS. 1 and 6, indicia fixed on the mast 22, allows for accurately reproducible angles and thereby feeding intervals or rates. As can be seen in FIG. 3, the liquid level L in a bottle B will decrease as an infant drinks, to a point where liquid is no longer accessible to an opening 0 in the nipple N. The point at which the liquid level L becomes inaccessible is determined by the angle of the bottle holder 18. Thus, a feeding interval can be predetermined by the proper angular positioning of the bottle holder 18.

Referring again to FIG. 1, it can be seen that the base 16 is generally shaped to fit the contours of an infant's torso. The second base end 28 extends to a point between the infant's legs (or to a point below the portions 48 in its peripheral edge proximate to the second base end 28. The recessed portions 48 are adapted to accommodate the inner thigh of an infant when the infant's legs are bent.

The bottle prop 12 is stabilized on the infant due to the contoured shape of the base 16. The bottle prop 12 is further stabilized by the engagement of the recessed peripheral edges 48 of the base 16 between the infant's legs. The engagement of the infant's thighs with the recessed portion 48 of base 16 is particularly advantageous when the infant is seated in a conventional reclining child seat wherein the infant's legs are bent at a seated angle.

Figure 7:
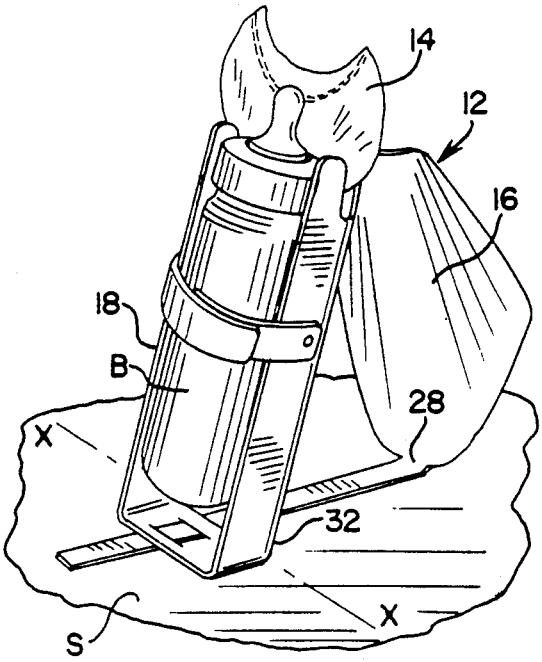
FIG. 7 is a perspective view showing the bottle prop of FIG. 1 supported on a flat surface in an upright position as when the bottle prop is not in use.

FIGS. 7 best discloses that the second bottle holder end 32 presents a generally flat edge surface as indicated by line X—X. The length of the bottle holder is dimensioned to cooperate with the second base end 28 so that the second bottle holder end 32 and the second base end 28 provide support for the bottle prop 12 when it is placed on a flat surface such as surface S of FIG. 7. This configuration is particularly advantageous because when the bottle prop 18 is not in use on an infant the bottle B can be placed in a generally upright position thus preventing leakage from the bottle B.

Preferably the bottle prop 12 is fabricated from a durable plastic and fabricated substantially as a single piece. When fabricated substantially as a single piece, the mast 22 and the bottle holder 18 are hingeably attached to the base 16 as a conventional "living hinge" as disclosed in the drawings.

Figure 5:
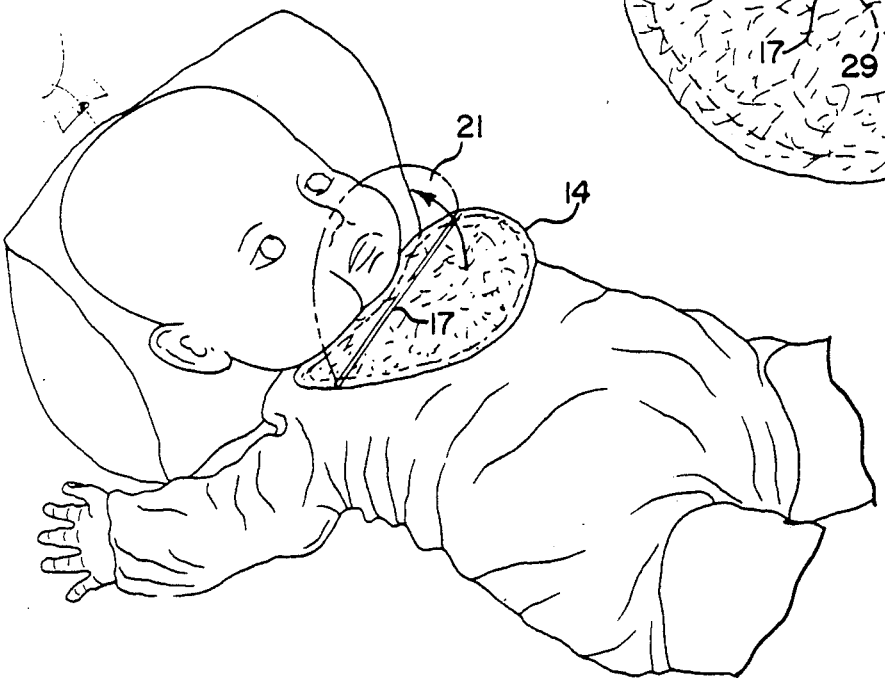
FIG. 5 is a perspective view showing the use of the bib of FIG. 4 between feeding intervals.

FIGS. 4 and 5 best disclose the bib 14 of system 10. The bib 14 includes at least two substrate layers superimposed on and attached to each other. The bib 14 being generally flat with opposed sides surfaces and a circular periphery. A portion 15 of the periphery of the bib 14 is recessed in an arcuate shape to fit around an infant's neck.

Although the system 10 contemplates bibs of other peripheral geometries, the circular shape of the bib 14 is preferred. This is because it is easier to dispose a circular edge into a slot such as bib slot 20. The circular shape also enhances the tendency of the bib 14 to remain erect in the bib slot 20.

As discussed above, one mode of using the system 10 provides that the bib 14 remains disposed in slot 20 even when the bottle prop 12 is removed from the infant between feeding intervals. However, according to another mode of using the system 10, the bib 14 includes two pressure sensitive adhesive strips 31 and 33 on one of its sides for adhering the bib 14 to the infant's clothing. Advantageously, this provides for the bib 14 to be automatically withdrawn from the bib slot 20 and remain in place when the bottle prop 12 is removed from the infant. The pressure sensitive adhesive strips 31 and 33 also allow the bib to be used subsequent to feeding for any liquid which may be expelled by the infant during burping.

The system 10 generally contemplates that the bib 14 will be made of inexpensive materials and will be disposable. It has been found that a lactating breast pad such as described in U.S. Pat. No. 4,074,721 provides a good stock from which to fabricate a bib such as bib 14. In the alternate mode, release papers are releasably attached to the pressure sensitive adhesive strips 31 and 33 during storage and removed just prior to use on an infant.

According to another aspect of the invention a seam 17 is formed across a medial portion of the bib 14 to join the two substrate layers. The seam 17 defines an upper portion 19 of the bib 14 and a lower portion 21 of the bib 14. An elongated rigid member 23 (shown in ghost at FIG. 4) is disposed in the upper portion 19 between the substrate layers of bib 14. The rigid member has two symmetrically oriented legs 25 and 27 joined at a central point 29. The rigid member 23 is oriented so that the central point 29 of the rigid member 23 abuts the seam 17 and the legs 25 and 27 generally encompass the recessed portion 15 of the periphery of the bib 14.

The rigid member 23 so disposed adds rigidity to the upper portion 19 and tends to maintain the bib 14 in a given position. This permits the lower portion 21 of the bib 14 to be hinged along the seam 17 and movable with respect to the upper portion 19 of the bib 14. Thus, when the bottle prop 12 is withdrawn from the infant, the bib can be flipped up to cover the mouth of an infant and flipped down on the infant's chest.

Although the invention contemplates that rigid member 23 is rigid enough to add stiffness to upper portion 19 of bib 14, such rigidity is meant to be relative to generally non-stiff bib construction materials such as paper or cloth fabrics. Thus the invention also contemplates that a rigid member 23 may be provided which is formable by hand to shape the bib 14 around the infant's particular contours to obtain maximum fit.

Thus, to use system 10 a parent need only fill a nursing bottle then secure it in the bottle prop 12 and place the bottle prop on the infant with base 16 on the front torso of the infant. While transferring the system 10 to the infant with the bottle inverted in the bottle prop 12, the bib 14 will catch any fluid leakage. As the bottle prop 12 is set on the infant, the bib 14 is easily guided under the infant's chin by merely directing the bottle prop 12. Then the bottle holder 18 can be adjusted to provide any feeding interval or rate desired. When the feeding is finished or between intervals the bottle prop 12 need only be lifted from the infant and set upright on a support surface to avoid leakage or soiling of the nipple.

In an alternate mode, before placing the bottle prop on the infant, any release papers are removed from the adhesive strips 31 and 33. The bib 14 is then smoothed to the infant's clothing for adhesion thereto once the bottle prop 12 is in place. In this mode the bib 14 will automatically withdraw from the bib slot 20 as the bottle prop 12 is removed so that the bib 14 will remain on the infant to catch expelled fluids. At that time the lower portion 21 of bib 14 may be flipped up for wiping the infant's mouth.

Figure 8:
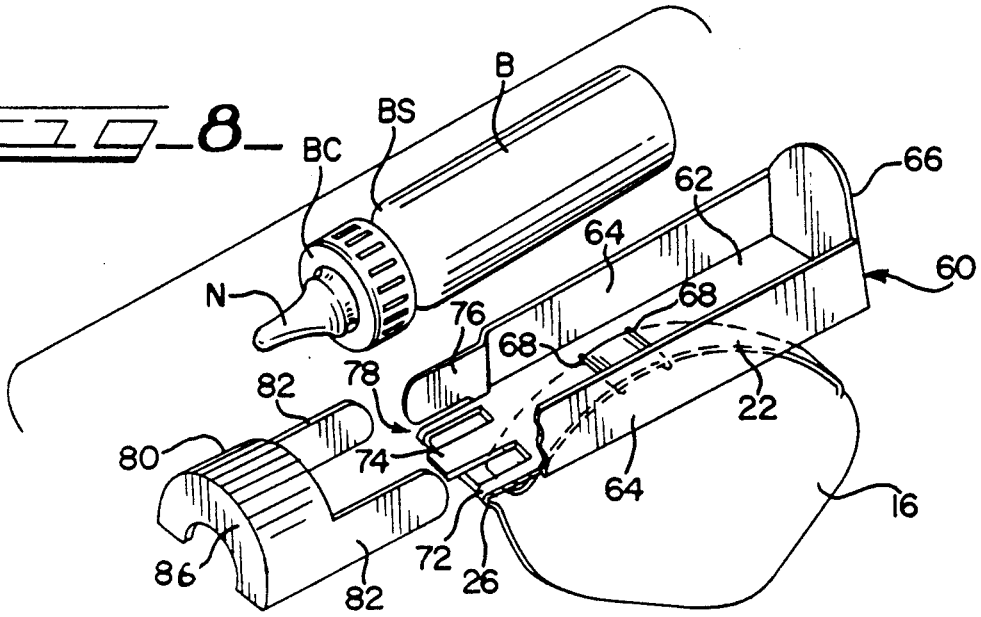
FIG. 8 is a perspective exploded view of another embodiment of the bottle prop of the present invention with a partial cutaway.
Figure 9:
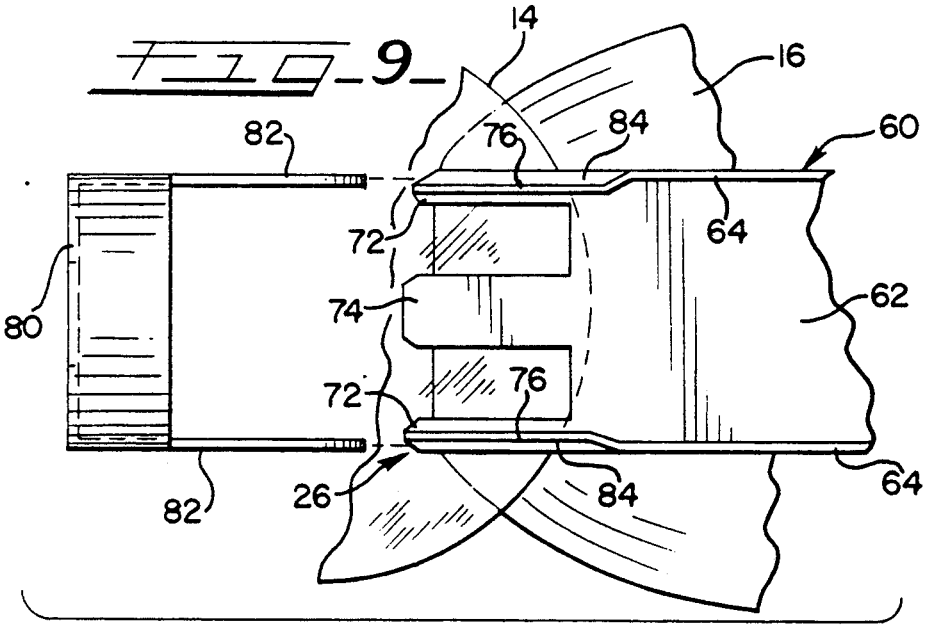
FIG. 9 is a partial top view of the embodiment disclosed in FIG. 8; and, FIG. 10 is a side cross-sectional view of the embodiment disclosed in FIG. 8.
Figure 10:
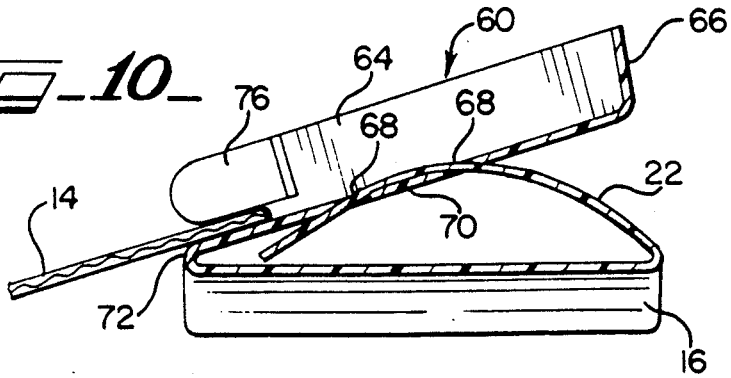

FIGS. 8, 9 and 10 disclose another embodiment of the invention, wherein a bottle holder 60 is hingeably attached to the base 16.

The bottle holder 60 has a bottom wall 62 for supporting the bottle B. Opposed side walls 64 and end wall 66 extend perpendicularly from bottom wall 62 to form a three sided enclosure for bottle B.

The mast 22 of base 16 is disposed through two spaced parallel openings or mast slots 68 in bottom wall 62. As best disclosed in FIG. 10 a portion 70 of bottom wall 70 is defined between the mast slots 68. The portion 70 operates the same as portion 44 of bottle holder 1 described above.

The bottle holder 60 operates the same as bottle holder 18 described above with respect to adjustment of the angle of the bottle holder 60 to the base 16. However, the mast 22 being disposed beneath the bottom wall 64 allows the bottle prop 12 to be more compact for storage purposes. For example, when the system 10 is not in use, the bottle holder 60 need only be pushed toward base 16 until bottom wall 62 is essentially flat against base 16. In this position mast 22 is not protruding.

FIGS. 8 and 9 also disclose an alternate slot configuration for frictionally engaging the bib 14 of system 10.

The bottom wall 62 of bottle holder 60 extends to form a living hinge 72 with base 16 at first base end 26. A tab 76 is formed on the end of each side wall 64 of bottle holder 60. The bottom wall 62 extends beneath each tab 76 to form two bib slots 78. A tongue 74 is formed on the end of bottom wall 62 by relieving a portion of the living hinge 72.

As best disclosed in FIG. 9, bib 14 is engaged by bottle prop 12 by being disposed into each bib slot 78 while underlying tongue 74. In this configuration, the tongue 74 provides added frictional engagement of the bib 14 and allows the bottle B to be slide freely over the bib 14 when loading the bottle B into the bottle holder 60.

FIGS. 8 and 9 further disclose alternate means to secure the bottle B in the bottle holder 60. A cowel 80 is C-shaped to cover just the front and top portion of a bottle residing in the bottle holder 60. The cowel 80 has two cowel tabs 82 which are dimensioned to fit in cowel tab recesses 84 which are formed in tabs 76. The cowel tabs 82 and recesses 84 are adapted to frictionally fit together so that the cowel 80 can be removed for cleaning. Cowel 80 has a C-shaped end wall 84 which is dimensioned to engage the bottle B while allowing a nipple N of the bottle to protrude toward an infant's mouth. It should be noted that the C-shaped cowel end wall 84 can be dimensioned to engage a bottle B either at a cap BC of the bottle B or at a shoulder BS of the bottle B (as shown in FIG. 8) depending on the amount of nipple protrusion desired. It should also be noted that the cowel 80 is preferably not removed to install or remove a bottle B. Rather, the bottle holder 18 is dimensioned in its length to permit a bottle B to be inserted therein with the cowel 80 in place. When the bottle holder 18 is angled, the bottle B is held against the cowel end wall 84 by gravity.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

I claim:

1. A bib comprising:

a substrate having at least two layers superimposed on and attached to each other, the substrate being generally flat with opposed side surfaces and a generally circular periphery, a portion of the periphery of the substrate being recessed in an arcuate shape to fit only around a front portion of a wearer's neck generally under the chin;

an elongated rigid member formable to the contours of the wearer generally encompassing said recessed arcuate portion disposed between and being fully contained within the layers of the substrate; and, a pressure sensitive adhesive disposed on one side surface of the substrate for adhering the substrate to a wearer.

2. A bib comprising:

a substrate having at least two layers superimposed on and attached to each other, the substrate being generally flat with opposed side surfaces and a periphery, a portion of the periphery being recessed in an arcuate shape to fit around a portion of a wearer's neck;

a rigid formable member disposed between the layers of the substrate to the contours of the wearer; and, a pressure sensitive adhesive disposed on one side surface of the substrate for adhering the substrate to a wearer.

3. A bib comprising:

a substrate having at least two layers superimposed on and attached to each other, the substrate being generally flat with opposed side surfaces and a periphery, a portion of the periphery being recessed in an arcuate shape to fit around a portion of a wearer's neck;

a hinge formed entirely across a medial portion of the substrate joining the layers along the hinge and defining an upper portion of the substrate and a lower portion; and, an elongated rigid member disposed between the layers in the upper portion, the rigid member having two legs joined at a central point, the rigid member being oriented so that the central point of the rigid member abuts the hinge and the legs generally encompass the portion of the periphery being recessed to fit around a portion of a wearer's neck, whereby the lower portion of the substrate is hingeably moveable with respect to the upper portion of the substrate.

4. The bib of claim 3 including a pressure sensitive adhesive disposed on one side surface of the upper portion of the substrate for adhering the substrate to a wearer.

5. A bib comprising:

a substrate having at least two layers superimposed on and attached to each other, the substrate being generally flat with opposed side surfaces and end surfaces, one said end surface being recessed to provide for a wearer's neck; and an elongated rigid member formable to the contours of the wearer generally encompassing said recessed portion disposed between and being fully contained within the layers of the substrate.

6. The bib of claim 5 further comprising:

(a) a hinge formed entirely across a medial portion of said substrate joining said layers along said hinge and defining an upper portion and a lower portion of said substrate, and (b) said formable member being an elongated rigid member disposed between said layers in said upper portion of said substrate, said rigid member having a plurality of legs joined at a central point and being oriented so that said central point abuts said hinge.

7. The bib of claim 6 wherein said lower portion moves about said hinge between a first position and a second position, in said first position said lower portion contacts the wearer's mouth and in said second position said lower portion rests on the wearer's chest.

* * * * *